United States Patent [19]

Stepan et al.

[11] 4,101,980

[45] Jul. 25, 1978

[54] PROTECTIVE DEVICE HAVING A SHIELD FOR PROTECTING THE FACE OF A USER

[75] Inventors: Walter Stepan, Allersberg; Klaus Hennecke, Schwabach, both of Germany

[73] Assignee: UVEX Winter Optik GmbH, Fürth, Bay, Germany

[21] Appl. No.: 678,135

[22] Filed: Apr. 19, 1976

[30] Foreign Application Priority Data

Apr. 26, 1975 [DE] Fed. Rep. of Germany ... 7513464[U]

[51] Int. Cl.[2] ..... A42B 1/08; A61F 9/00

[52] U.S. Cl. ..... 2/9; 2/424; 2/434

[58] Field of Search ..... 2/424, 434, 436, 437, 2/441, 9, 6, 10

[56] References Cited

U.S. PATENT DOCUMENTS

| | | | |
|---|---|---|---|
| 1,800,558 | 4/1931 | Moran et al. | 2/434 |
| 3,081,461 | 3/1963 | Gurtowski | 2/441 |
| 3,488,215 | 1/1970 | Shepherd et al. | 2/435 X |
| 3,517,393 | 6/1970 | Beauchef | 2/436 |
| 3,825,952 | 7/1974 | Pershing et al. | 2/422 |
| 3,858,242 | 1/1975 | Gooding | 2/10 |
| 3,911,914 | 10/1975 | Johansson | 2/424 X |

FOREIGN PATENT DOCUMENTS

| | | | |
|---|---|---|---|
| 286,674 | 3/1928 | United Kingdom | 2/436 |

*Primary Examiner*—Peter Nerbun

*Attorney, Agent, or Firm*—Browdy and Neimark

[57] ABSTRACT

A protective device for protecting the face of a user includes a face shield made of flexible, shatterproof plastic and a guard pivotably mounted on the shield and at least partially covering it. The guard is made of scratch-resistant glass. The guard may be mounted over a cutout or opening in the shield and can be pivoted away.

10 Claims, 6 Drawing Figures

PROTECTIVE DEVICE HAVING A SHIELD FOR PROTECTING THE FACE OF A USER

FIELD OF THE INVENTION

This invention relates to a protective device including a shield to be worn in front of the face and, more particularly, to such devices for safety helmets, made of a flexible, shatterproof plastic.

BACKGROUND OF THE INVENTION

Transparent shields of the type to be worn in front of the face, especially designed to be attached to safety helmets for motorcycle riders, to so-called hard hats for workers, or to mounting rings or mounting straps worn on the head, are usually made of polycarbonate or cellulose acetate. These plastics have the considerable advantage that they are flexible, i.e., the shield is stamped out of a sheet and can then be bent to the shape of a helmet, and that they do not shatter when struck. On the other hand, they have the considerable disadvantage that they are not scratch-resistant. In practice, the shields of safety helmets worn by motorcycle riders of workers' hard hats very quickly become dirty. The only possibility for the wearer to effect at least partial cleaning during riding or during work involves wiping off the shield with his bare hand or with a glove, i.e., dry-wiping it; in a short time this results in scratching of the shield, making it unusable. In the case of shields for motorcycle riders, because of this problem, it has been proposed that a portion of the transparent shield be made interchangeable, with this interchangeable part being made of the same material as the shield. This design has not managed to become general.

It is known from U.S. Pat. No. 3,377,625 to provide ski goggles with a so-called double shield; both of these shields are sealed tightly together, thus preventing fogging of the inside of the inner shield due to the high insulating properties. The double shield in any case is made of a homogeneous material.

SUMMARY OF THE INVENTION

It is the object of the present invention to provide a protective device including a shield made of flexible, shatter-proof plastic and having a viewing area which cannot become scratched.

The foregoing object, as well as others which are to become clear from the text below, is achieved according to the invention by the combination of a shield with a guard made of scratch-resistant natural glass, the guard being on and at least partially covering the shield.

The combination according to the invention of a shield made of flexible, transparent and shatterproof plastic with a guard made of scratch-resistant, relatively hard natural glass results in the viewing area, i.e., the outside of the natural glass guard, being capable of being cleaned even during riding or during work, without the danger of scratching, i.e., the usability of a shield made in this manner is considerably lengthened.

According to an advantageous embodiment of the invention, if the guard is mounted on the front surface of the shield, i.e., if the face shield itself does not have an opening in it, this preferred combination produces the desired effect that the inside of the face shield in the area where the guard and face shield overlap will not fit at all or, in any case, to a much lesser degree. In addition, the face shield acts as a protection against fragments in the event that the guard should shatter. Safety can be markedly increased in general if the guard is made of safety glass, usually tempered glass, i.e., so-called tempered safety glass or compound glass.

According to a further advantageous variant of the invention, the guard is mounted in a removable and interchangeable fashion to the face shield, it is easy and simple to replace a damaged guard. This is accomplished in a particularly simple manner if the guard is held in a frame made of soft plastic material which fits tightly around its inner and outer edges and presses it tightly against the face shield. In the embodiment described hereinabove, in which the face shield has no opening in it, a relatively tightly sealed air space is simultaneously produced between the face shield and the guard, i.e., the danger of fogging on the inside of the face shield is particularly slight.

According to another also especially advantageous embodiment of the invention, the guard covers a corresponding opening or cutout in the face shield, it being particularly simple to attach and remove the guard, since it is then possible, in a particularly advantageous manner, for the frame to fit over the edge of the opening or cutout. As far as the necessary manufacturing precision and aesthetic appearance are concerned, it is advantageous if a sealing and covering ring is provided to fit around the frame on its front side. The guard can also be provided on its rear side, i.e., on the side facing the face of the wearer, with a coating which prevents fogging, as described and claimed in U.S. Pat. application Ser. No. 528,688 now abandoned.

Further advantages and features of the invention will be seen from the description of three sample embodiments with reference to the accompanying drawing figures.

DETAILED DESCRIPTION OF THE PREFERRED EMBODIMENTS

Figure 1:
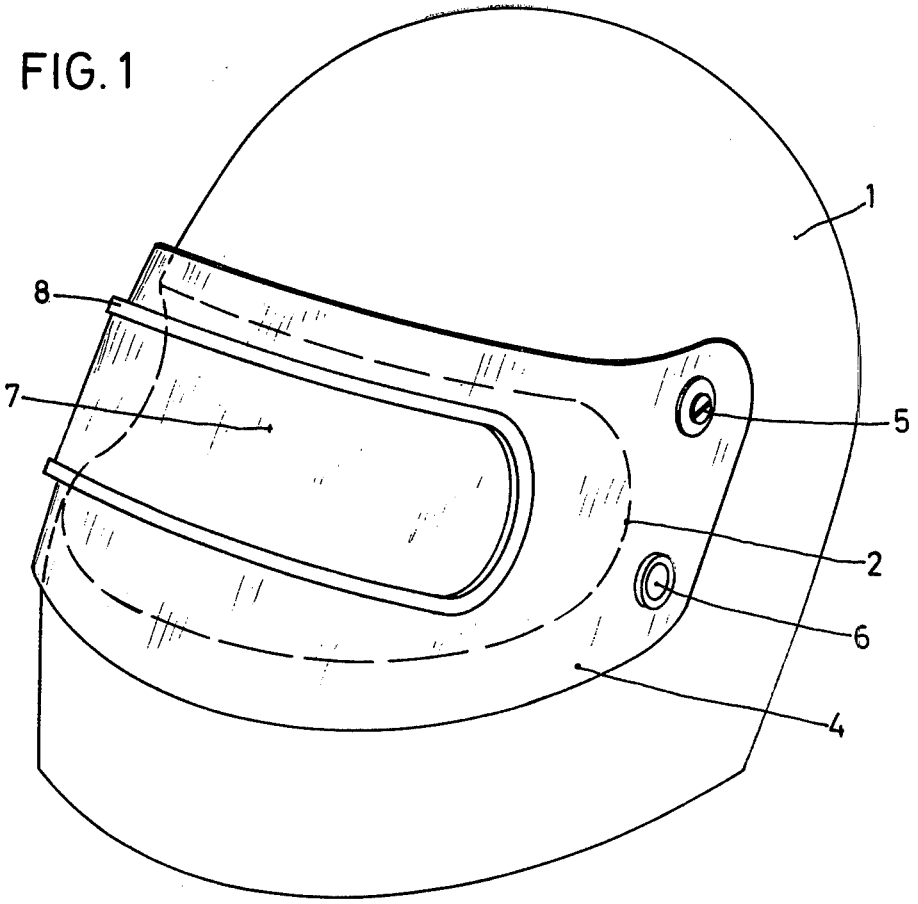
FIG. 1 is a perspective outside view of a safety helmet according to the invention.

The safety helmet shown in FIG. 1 includes, in known fashion, a shell 1 provided on the inside with a lining (not shown). The shell 1 is provided in its forward and forward lateral area with a viewing opening 2, covered by a face shield 4 made of transparent, flexible, shatterproof plastic, for example polycarbonate, having a thickness of about 1 mm. The face shield 4 is attached to the shell 1 by screws 5 or the like in such manner that it can be swiveled upward on a swivel axis defined by the screws 5 so that the viewing opening 2 may be exposed, if desired. In order to prevent the face shield 4 from swiveling upward during travel when not desired, a releasable pushbutton connection 6 is provided between the face shield 4 and the shell 1.

Figure 2:
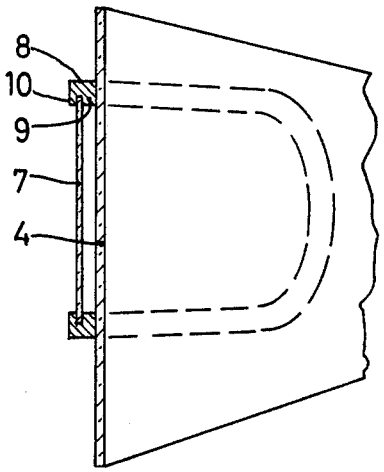
FIG. 2 is a side, vertical cross section through a face shield with a guard made of glass according to the invention.

A guard 7 made of hard, scratch-resistant natural glass, especially tempered glass, is mounted on the front side of the face shield 4, covering it only partially and overlapping the field of vision of the wearer. This guard 7, which is made in the shape of a section of a circular cylinder, and follows the surface contours of the face shield 4 in the overlapping region, is mounted in front of the outside of the face shield 4, at a distance of from about one millimeter to about four millimeters. The guard 7 is held in a frame 8 which is roughly U-shaped in cross section, as shown in FIG. 2. The frame 8, which accepts the shield 7 around its entire circumferential edge, is glued to the face shield 4 at its inside shoulder 9 or is soldered or otherwise fixed to it. An outside shoulder 10 fits over the outside edge of the guard 7, so that the guard 7 is held largely airtight in a recess provided between the shoulders 9 and 10 of the frame 8. The material of frame 8 is such that the frame is sufficiently deformable and the outside shoulder 10 is sufficiently short, that the relatively hard guard 7, after the frame 8 has been attached to the face shield 4, can be fitted into or taken out of the latter. The inside surface of the face shield 4 can also be provided with a protective coating which reduced fogging, as is known for example from the aforementioned U.S. Pat. application Ser. No. 528,688, now abandoned. The measures according to the invention in this connection have the additional advantage that it is economically feasible to apply such protective coatings, since the lifetime of the face shield 4 is considerably lengthened thereby.

Figure 3:
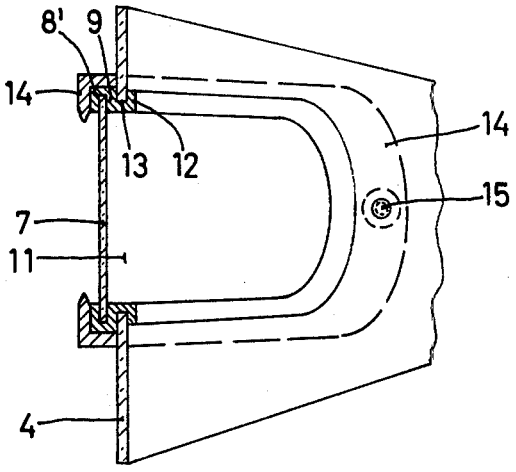
FIG. 3 is a side, vertical cross section through a face shield with a guard made of glass constituting a variant of the combination shown in FIG. 2.

In the modified embodiment shown in FIG. 3, a cutout 11 is provided in the face shield 4 in the area covered by the guard 7, this cutout being slightly smaller than the guard 7. A frame 8' is also provided with additional shoulder 12 directed upwardly so that the inside shoulder 9 and a shoulder 12 receives an edge 13 of the face shield 4 which delimits the cutout 11. In addition, the frame 8' is made of a solid plastic, for example, polyethylene, so that the shoulder 12 can be readily deformed to the extent that the frame 8' can be easily attached to the face shield 4 or released from the latter.

In addition, a sealing and covering ring 14 with an approximately L-shaped cross-section is provided, which covers all of the part of the frame 8' which is on the front side of the face shield 4. This sealing and covering ring 14 is releasably attached in the vicinity of the lateral ends of the guard 7 by screws 15 to the face shield 4.

In this embodiment, it is advantageous to provide the inside of the guard 7, in other words the side toward the face of the wearer, with a protective coating which resists fogging, as described and claimed in aforementioned U.S. Pat. application Ser. No. 528,688, now abandoned.

In the case of so-called hard hats for workers or holding rings or holding straps to be worn on the head, face shields designed to be swung upward are made in the same fashion as the face shields described above for use on safety helmets.

Figure 4:
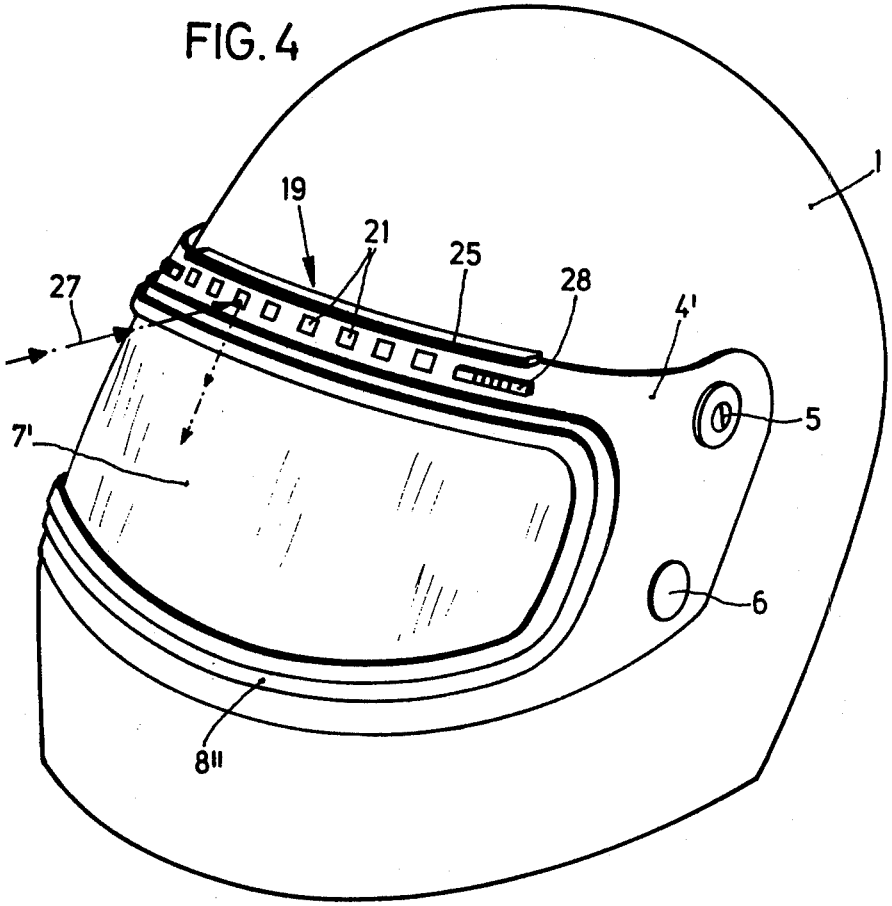
FIG. 4 is a perspective outside view of a further embodiment of the face shield and guard according to the invention on a safety helmet.
Figure 5:
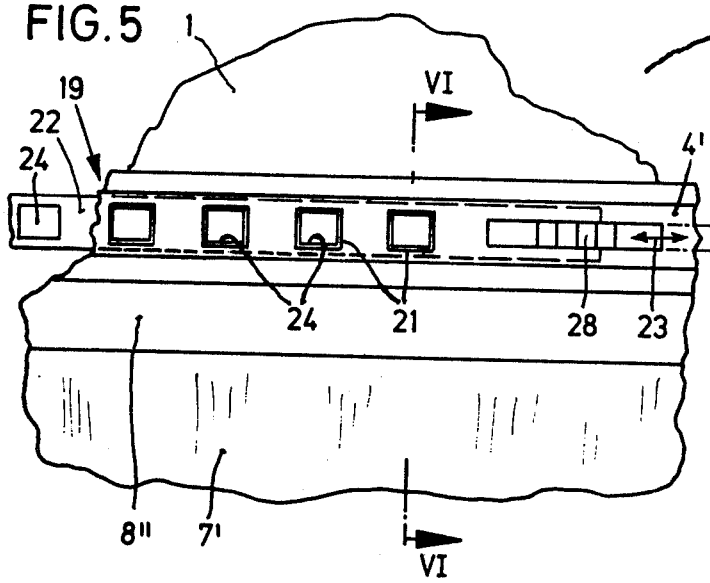
FIG. 5 is a partial cutout from the face shield according to FIG. 4 on an enlarged scale.
Figure 6:
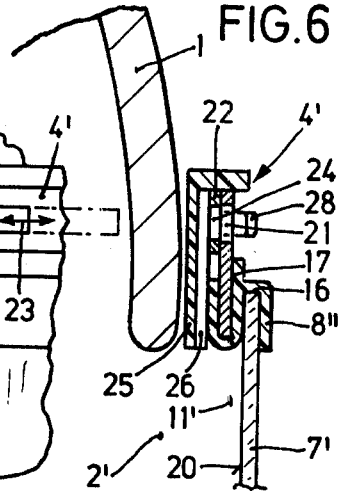
FIG. 6 is a side, sectional view of the cutout of FIG. 5, the section being taken along line VI—VI in FIG. 5.

In the design according to FIGS. 4–6, a face shield 4' is made of a nontransparent plastic that can be formed by injection molding and is fastened in the same manner as in FIG. 1 by screws 5 and a pushbutton connection 6 to a shell 1 of the safety helmet. A guard 7' also made of tempered glass covers a viewing aperture 2' of the safety helmet almost completely. It is held in front of a cutout 11' in the face shield 4' by an elastic frame 8'' made of rubber. This frame 8'' is provided on its inner edge with a circumferential recess 16, in which the guard 7' in the form of a pane with its round edge can be inserted. In addition, the frame 8'' has a recess 17 which is open to the outside, runs around it, and can accept the round edge of the cutout 11' of the face shield 4'.

A device 19 for ventilating the inner side 20 of the guard 7' is provided in the upper part of the face shield 4'. The face shield 4' is provided in its upper part with a row of rectangular openings 21. A strip-shaped slider 22 is provided behind these openings 21, this slider being displaceable in the direction of arrows 23, as shown in FIG. 5.

The slider 22 is provided with openings 24 which are of about the same size and the same cross section as the openings 21. The distance between two adjacent openings 21 or between two adjacent openings 24 is at least equal to their horizontal length, so that the openings 21 can be caused to overlap either partially or completely with the openings 24, or can also be completely closed by the slider 22. Behind the openings 21, appropriately mounted in a rear covering strip 25, are channels 26. The channels 26 are directed downward and open downward, through which the air stream generated during travel can enter through the partially or completely open openings 21 in the direction of arrow 27, shown in FIG. 4, and can flow from the top along the inner side 20 of the guard 7', thus making it possible to prevent the guard 7' from becoming coated with moisture. The shield 22 can be slid in the direction of the arrow 23 by means of projections 28 provided on this shield 22. These projections 28 project through corresponding recesses in the face shield 4'. In addition to the device 19 for ventilating the inner side 20 of the guard 7', the guard 7' can naturally be provided with a protective coating, as already mentioned hereinabove, to prevent it from foggint. In particular, in this sample embodiment, the face shield 4' can be made of a nontransparent material. Since the frame 8'' is made of elastic material, a damaged or destroyed guard 7' can easily be removed by elastically distorting the frame 8'' and can be replaced by a new guard 7'.

We claim:

1. A face shielding, protective device for use by a user in connection with a safety helmet comprising, in combination:

a contoured face shield of a flexible, transparent, shatterproof plastic, said shield having a front side which is to face away from the user;

means on said shield for movably attaching said shield to a helmet, said means for attaching defining a swivel axis;

a frame including a shoulder portion, said shoulder being affixed to said front side of said shield; and a guard made of scratch-resistant, mineral safety glass mounted in said frame, said guard being at least partially bent to conform to the contour of said shield and completely covering the field of vision of the user, and wherein said guard is mounted removably and interchangeably on said face shield.

2. A protective device according to claim 1, wherein said safety glass is tempered glass.

3. A protective device according to claim 4, wherein said frame is made of deformable plastic, said guard being fit within said frame on inner and outer edges thereof, and said frame being mounted tightly against said face shield.

4. A protective device according to claim 1, wherein said face shield has a cutout, said guard being positioned to cover said cutout in said face shield.

5. A protective device according to claim 4, wherein said cutout has an edge, and wherein said frame is positioned around said edge of said cutout.

6. A protective device according to claim 5, including a sealing and covering ring fit around said edge on its front side.

7. A protective device according to claim 1, wherein said guard is provided on its rear side with a coating which prevents fogging.

8. A protective device according to claim 1, including means for ventilating the inside of said guard, these means being provided in the vicinity of the periphery of said guard.

9. A protective device according to claim 8, wherein said means for ventilating includes openings which open toward the front of said guard, a slider for closing said openings, and at least one channel communicating with said openings, said channel opening to the inner side of said guard.

10. A protective device according to claim 9, wherein said at least one channel runs substantially parallel to said guard.

* * * * *